US008104637B2

(12) United States Patent
Trejo et al.

(10) Patent No.: US 8,104,637 B2
(45) Date of Patent: Jan. 31, 2012

(54) POP-UP HANGER ON DRUM

(75) Inventors: Kevin M. Trejo, Camarillo, CA (US); Chris McSweyn, Venice, CA (US)

(73) Assignee: Scosche Industries, Inc., Oxnard, CA (US)

( * ) Notice: Subject to any disclaimer, the term of this patent is extended or adjusted under 35 U.S.C. 154(b) by 449 days.

(21) Appl. No.: 12/313,697

(22) Filed: Nov. 24, 2008

(65) Prior Publication Data

US 2010/0127009 A1 May 27, 2010

(51) Int. Cl.
*B65D 25/22* (2006.01)

(52) U.S. Cl. ..... 220/751; 248/322

(58) Field of Classification Search ..... 242/607.1, 242/404.3, 613; 248/685, 686, 339, 322; 493/405; 220/751
See application file for complete search history.

(56) References Cited

U.S. PATENT DOCUMENTS

| | | | | |
|---|---|---|---|---|
| 609,228 | A * | 8/1898 | Clarke | 242/599.1 |
| 1,252,300 | A | 1/1918 | Phillips | |
| 2,632,613 | A | 3/1953 | Hack | |
| 3,729,092 | A | 4/1973 | Marcell | |
| 3,830,445 | A * | 8/1974 | Moore | 242/578.3 |
| 4,821,974 | A * | 4/1989 | Poehlein | 242/596.4 |
| 5,692,639 | A | 12/1997 | Lahaussois et al. | |
| 6,270,035 | B1 | 8/2001 | Lahaussois | |
| 6,367,725 | B1 | 4/2002 | Goodwin | |
| 7,137,607 | B2 | 11/2006 | Hibbs et al. | |
| 7,172,070 | B2 | 2/2007 | Coon et al. | |
| 7,222,734 | B2 | 5/2007 | Barton | |
| 2006/0016707 | A1 | 1/2006 | Chow et al. | |

* cited by examiner

*Primary Examiner* — Stephen Castellano
(74) *Attorney, Agent, or Firm* — William W. Haefliger

(57) ABSTRACT

A drum assembly having opposite ends and a cylindrical drum surface extending between the ends, and a central through opening extending between the ends, a support carried in the opening and having an extended position in which a portion of the support projects endwise from the opening and a retracted position in the opening, and there being retention structure associated with the opening to retain the support alternately in positions.

12 Claims, 3 Drawing Sheets

POP-UP HANGER ON DRUM

BACKGROUND OF THE INVENTION

This invention relates generally to wire supports as for display and use on a drum; and more particularly concerns an integrated wire support drum and movable plunger, enabling simple and effective hanging display of the drum and wire as in a store, and use of the drum and wire after removal from display.

There is need for a low-cost, effective, simple drum and wire support and hanging display, as in a retail store, and embodying the unusually advantageous features of construction, operation and results as are characterized by and in the present invention.

SUMMARY OF THE INVENTION

It is a major object of the invention to provide simple apparatus meeting the above needs. Basically, the invention is embodied in a drum assembly that includes:

a) a drum body having opposite ends and a cylindrical drum surface extending between said ends, b) a central through opening extending between said ends, and c) a support carried in said opening and having an extended position in which a portion of the support projects endwise from said opening and a retracted position in said opening, d) there being retention structure associated with said opening to retain the support alternately in said positions.

As will be seen, a display hanger is typically embodied on the support portion referred to; and the support is configured as a plunger endwise controllably movable in the drum opening. Such control is by finger pressure acting to push the plunger up and down, as between extended and retracted position.

Another object is to provide bore extents defining said opening, the plunger having frictional engagement with the bore extents acting to retain the plunger in each of said positions.

A further object is to provide body lands or ledges spaced apart in said opening to retain the plunger in each of its extended and retracted positions; and wherein the plunger has flange structure engagable with one of the lands to retain the plunger in said retracted position; and the plunger has first spring finger structure engagable with the other of said lands, to retain the plunger in its extended position.

Yet another object is to provide plunger second spring finger structure and frictionally engagable with one of said bore extents to resist endwise movement of the plunger in the opening.

A very simple and effective one-piece plunger structure incorporates cut-outs forming both the first and second spring fingers, as well as the hanger above the cut-outs, as will appear.

These and other objects and advantages of the invention, as well as the details of an illustrative embodiment, will be more fully understood from the following specification and drawings, in which:

DRAWING DESCRIPTION

DETAILED DESCRIPTION

Figure 1:
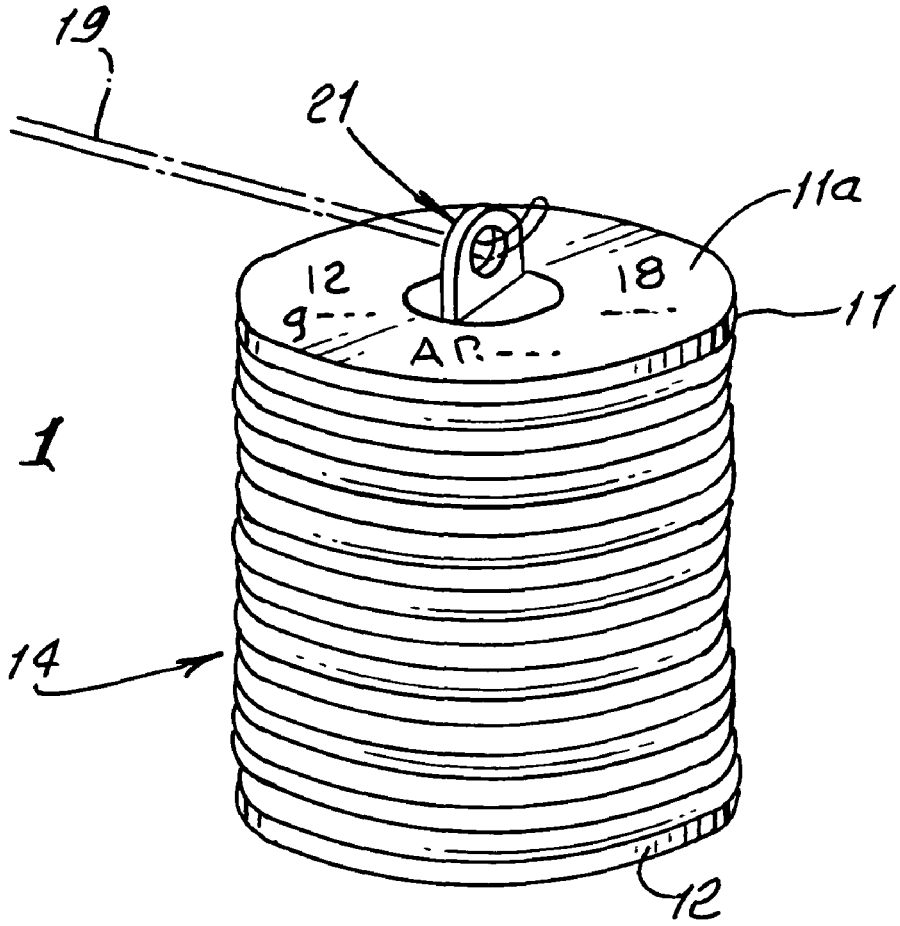
FIG. 1 is a perspective view of a drum, carrying wire, and showing the pop-up plunger and hanger, in upwardly extended position.
Figure 2:
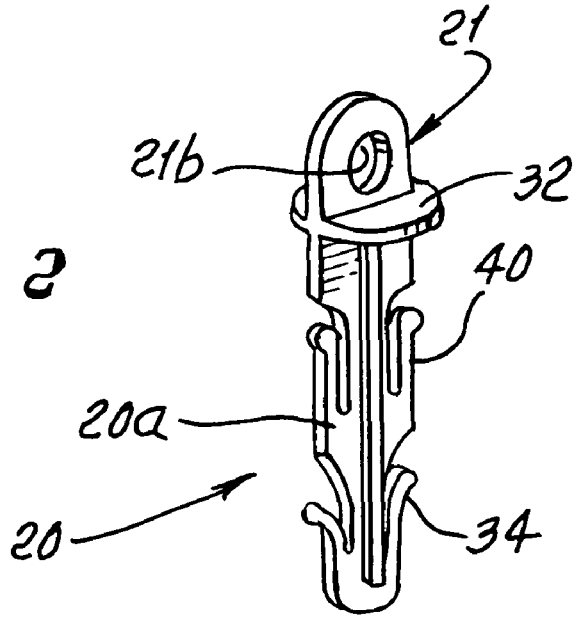
FIG. 2 is a perspective view of the plunger and hanger.

In the drawings, showing one preferred form of the device, a drum body 10 has opposite ends 11 and 12, and a cylindrical drum support 13 extending between those ends and radially inwardly thereof. Annular protective caps or covers 11*a* and 12*a* are provided at those ends to cover spaces 60 and 61 between 13 and drum body wall 60. Such covers may contain indicia. Wire, such as stereo speaker wire, is wound at 14 for storage on the drum, and covers surface 60*a*, as shown. The wire is confined between body annular flanges 15 and 16 at the drum annular ends. The wire may easily be unwound, after removal of the drum from hanging support as on a display cord 19.

Figure 3:
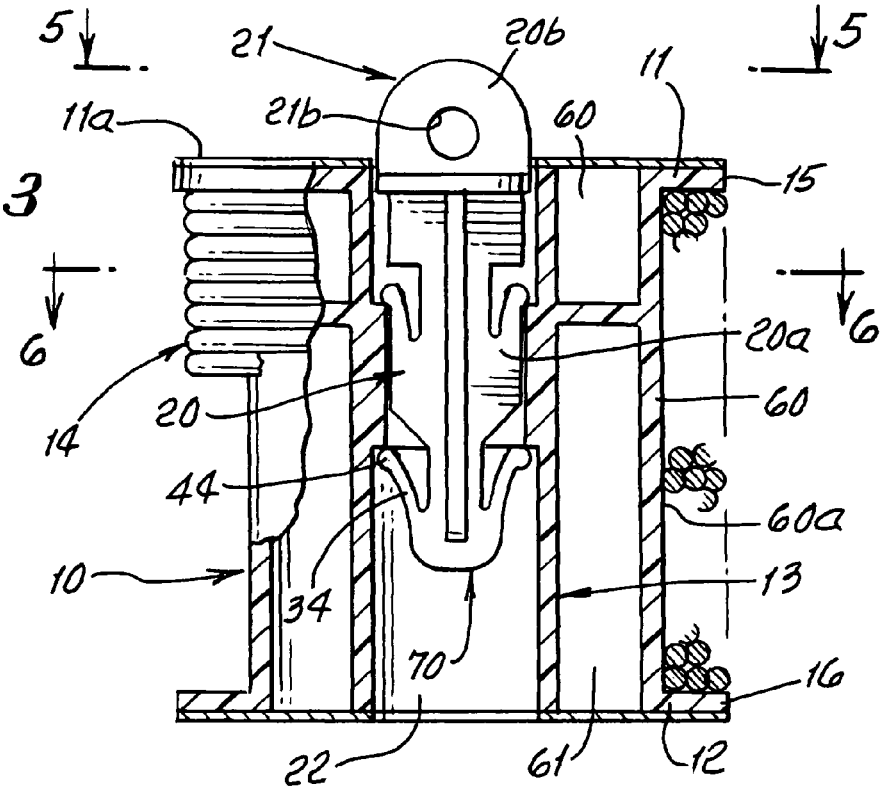
FIG. 3 is a vertical section through the drum, with the plunger and hanger in extended and up position.
Figure 4:
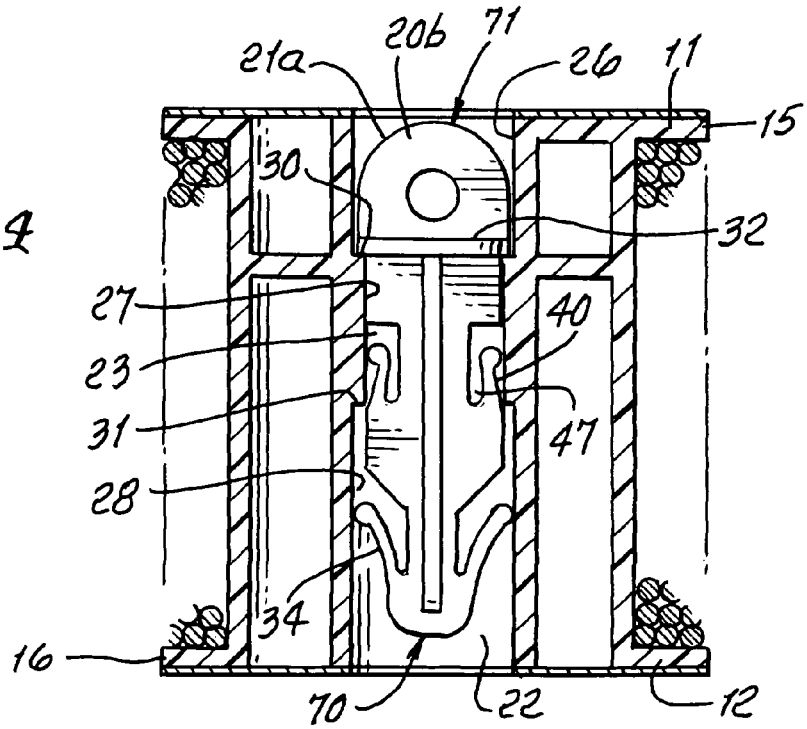
FIG. 4 is a view like FIG. 3, showing the plunger and hanger in downwardly retracted position.
Figure 5:
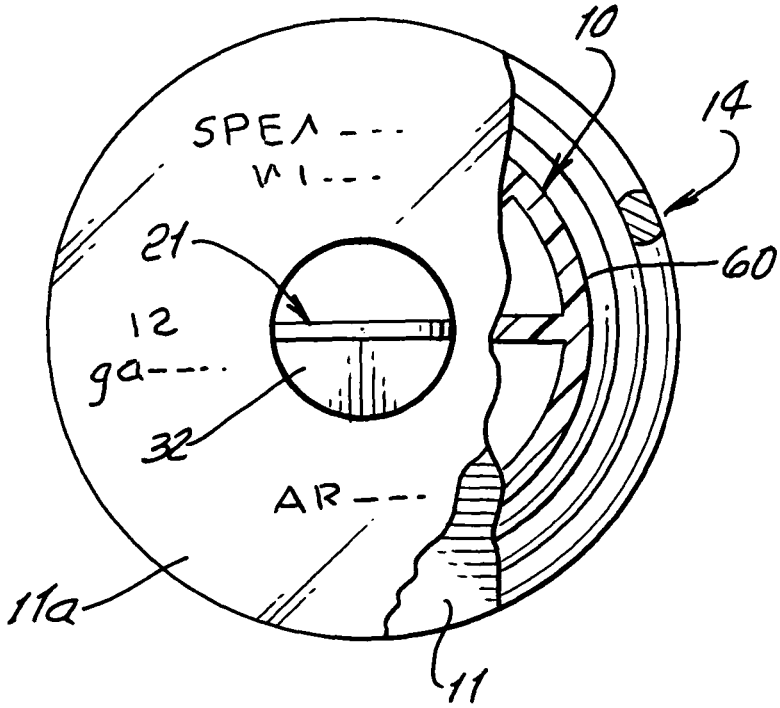
FIG. 5 is a top-plan view taken on lines 5-5 of FIG. 3.
Figure 6:
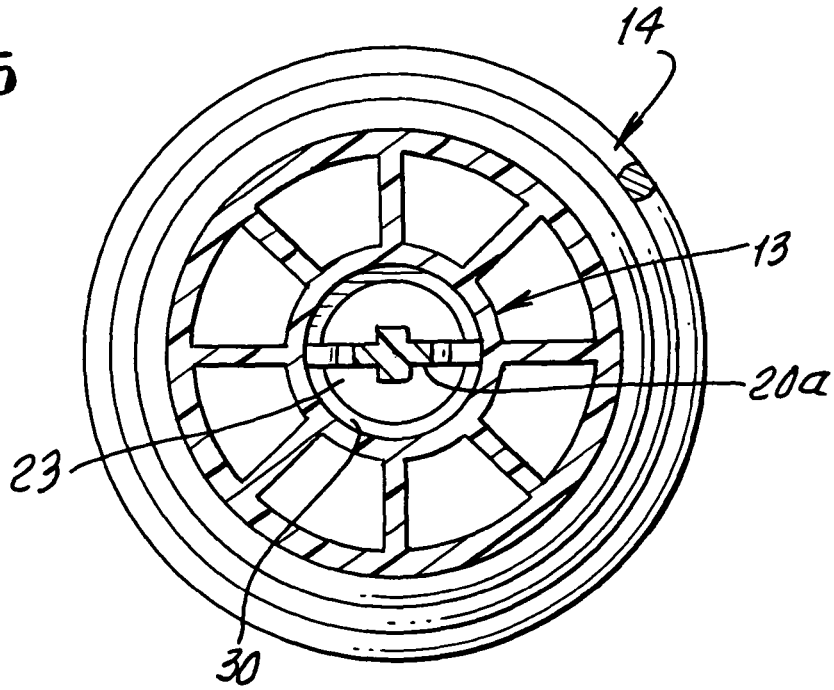
FIG. 6 is a horizontal section taken on lines 6-6 of FIG. 3.

A support 20, including a hanger 21, is associated with the drum, for hanging it on the cord 19, and the invention enables use of the drum and wire, after the support 20 is quickly and easily effectively displaced from extended position shown in FIGS. 1 and 3, and stored in retracted and protected position, as seen in FIG. 4, for further use.

To enable this, the drum has a central through opening 22 extending between ends 11 and 12, as within 13, and forming a concealed hanger and plunger storage zone 23, for storing the retracted plunger and hanger as seen in FIG. 4. In this regard, the support 20 may be considered to include plunger 20*a* and hanger 21, these being integrally connected or formed to enable their finger pressure controlled bodily movement between extended and retracted positions. For extension, finger pressure is exerted at 70; and for retraction, finger pressure is exerted at 71. The support 20 is carried in the opening 22, and in its extended position as in FIG. 3, a portion 20*b* of the support, which incorporates hanger 21 projects endwise from the opening 22. In FIG. 4, the retracted support is fully located in the opening, and at the storage zone or position. Hanger 21 is shown to include a convex top edge 21*a* above the level of a transverse opening 21*b* used for hanging.

In accordance with additional features of the invention, the body has bore extents defining the opening 22 and storage zone 23, and the plunger has frictional engagement with such bore extents as during plunger push-down displacement, acting to guide the plunger and frictionally resist its travel, as between FIG. 3 and FIG. 4 positions. See bore cylindrical extents 26, 27 and 28. Extent 27 may be regarded as a bore, and extents 26 and 28 are counter-bores.

In addition, the body has ledges or levels spaced apart in the opening to retain the plunger, axially, in each of its extended and retracted positions. See annular ledge or land 30 between 26 and 27, and ledge or land 31 between 27 and 28. The plunger has flange structure at 32 engagable with land 30 to retain or stop the plunger, axially, in retracted position; and the plunger has first spring finger structure, such as fingers 34, engagable with the land 31 to retain the plunger, axially, in extended position.

The plunger also has second spring finger structure, such as fingers 40 frictionally engaged with bore extent 27 to frictionally resist endwise movement of the plunger in the opening. Such frictional resistance also holds the plunger in retracted position, until finger pressure exerted at 70 overcomes such resistance, and allows the plunger "pop-up", i.e. travel to FIG. 3 position, with the hanger exposed for hanging support of the drum.

In FIG. 3 position of the elements, the ends 44 of the spring fingers 34 engage land 31 to limit upward travel of the plunger, as shown in FIG. 3.

Finally, the plunger, in the form of a plastic or metal plate, has cut-outs 46 forming the first spring fingers; and the plunger has cut-outs 47 forming the second spring fingers. These enable a very simple, low-cost, and effective one-piece construction of the plunger, hanger, spring fingers, and the cut-outs.

What is claimed is:

1. In combination in a drum assembly:

a) a drum body having opposite ends and a cylindrical drum surface extending between said ends, b) a central through opening extending between said ends, and c) a support carried in said opening and having an extended position in which a portion of the support projects endwise from said opening, and a retracted position in said opening, there being spring finger structure carried by the support to extend endwise in said opening, and to limit support travel between said positions, d) there being retention structure associated with said opening to retain the support alternately in said positions.

2. The assembly of claim 1 including a hanger on said portion of the support.

3. The assembly of claim 1 wherein said support is configured as a plunger endwise movable in said opening.

4. The assembly of claim 1 including wire spooled on said drum body.

5. The assembly of claim 4 wherein said wire comprises vehicle stereo speaker wire, approximately 12 gauge.

6. The assembly of claim 2 including display structure on which said hanger is hung.

7. In combination in a drum assembly:

a) a drum body having opposite ends and a cylindrical drum surface extending between said ends, b) a central through opening extending between said ends, and c) a support carried in said opening and having an extended position in which a portion of the support projects endwise from said opening, and a retracted position in said opening, d) there being retention structure associated with said opening to retain the support alternately in said positions, e) said support being configured as a plunger endwise movable in said opening, f) said body having bore extents defining said opening, said plunger having frictional engagement with said bore extents acting to retain the plunger in each of said positions.

8. The assembly of claim 7 wherein said body has lands spaced apart in said opening to retain the plunger in each of said positions.

9. The assembly of claim 8 wherein the plunger has flange structure engagable with one of said lands to retain the plunger in said retracted position; and the plunger has first spring finger structure engagable with the other of said lands, to retain the plunger in said extended position.

10. The assembly of claim 9 wherein the plunger also has second spring finger structure and frictionally engagable with one of said bore extents to resist endwise movement of the plunger in the opening.

11. The assembly of claim 9 wherein the plunger has cut-outs forming said first spring fingers.

12. The assembly of claim 10 wherein the plunger has axially spaced cut-outs forming said first and second spring fingers.

* * * * *